United States Patent [19]

Leschinsky et al.

[11] 4,380,852

[45] Apr. 26, 1983

[54] MILL ROLL

[76] Inventors: Leonid K. Leschinsky, Zhdanov, prospekt Lenina, 76"B", kv. 60; Sergei V. Gulakov, Zhdanov, ulitsa, M. Mazaya, 41, kv. 2; Xenofont X. Stepnov, Zhdanov, ulitsa Dalnevostochnaya, 50, kv. 4; Boris I. Nosovsky, Zhdanov, ulitsa Kuprina, 23"A", kv. 30; Valery G. Bendrik, Zhdanov, ulitsa Ilicha, 55, kv. 2; Boris E. Dubinsky, Zhdanov, ulitsa Krasnogvardeiskaya, 19, kv. 2; Dmitry I. Isirov, Zhdanov, prospekt Lenina, 74, kv. 51; Viktor E. Zelensky, Zhdanov, bulvar Shevchenko, 93, kv. 7, all of Donetskaya oblast, U.S.S.R.

[21] Appl. No.: 227,395

[22] Filed: Jan. 22, 1981

[30] Foreign Application Priority Data

Jul. 17, 1978 [SU] U.S.S.R. ..... 2643439

[51] Int. Cl.[3] ..... B21B 27/00

[52] U.S. Cl. ..... 29/121.2

[58] Field of Search ..... 29/121.1, 121.2, 121.3–121.8

[56] References Cited

U.S. PATENT DOCUMENTS

| | | | |
|---|---|---|---|
| 2,793,585 | 5/1957 | Granitsas | 29/121.4 X |
| 3,893,795 | 7/1975 | Nauta | 29/121.1 X |
| 4,159,677 | 7/1979 | Smith | 29/121.4 X |

*Primary Examiner*—Eugene F. Desmond

*Attorney, Agent, or Firm*—Fleit, Jacobson & Cohn

[57] ABSTRACT

A mill roll has a working layer comprising alternate portions of unequal wear resistance properties along both the circumference and the generating line of the roll barrel. Each portion of the working layer may have the form of a square, rhomb, circle and others, if viewed on a developed surface of the working layer, while, in a plane of the roll cross-section, it is arranged so that its axis of symmetry is inclined at an angle to the radius of the roll.

1 Claim, 5 Drawing Figures

MILL ROLL

BACKGROUND OF THE INVENTION

1. Field of the Invention

The present invention relates to the art of rolling metals and more particularly to a mill roll structure. The invention may be useful at the metallurgical works for producing ferrous and non-ferrous metals.

All things being equal, the throughput of roll stands is determined by the amount of reduction of the metal piece per pass. Yet slippage of metal, when the rolls grip the piece and under steady state rolling conditions, will not permit the amount of reduction to be enlarged. This causes the throughput of the rolling mills to be decreased, the rolls and the components of the mill line to be broken down.

To improve the grip of the rolls on the metal being rolled and to prevent their slippage, it is imperative that the adherence between the rolls and the metal being rolled be increased. Two ways are possible in accomplishing the objective, these are: increasing the frictional force acting between the rolls and the metal being rolled or increasing the rolling load.

2. Description of the Prior Art

Known in the art are rolls wherein an effort was made to improve the grip on the metal by increasing the frictional force acting between the rolls and the metal being rolled / M. Ya. Brovman et al., Usovershenstvovanie tekhnologhiy prokatki tolstykh listov, (Improvements in rolling plates), Moskva, Metallurghya Publishers, 1969, page 84, FIG. 28. / Such rolls have indentations in the working surface thereof and this surface has metal deposited thereon to form a netlike structure.

Such rolls present problems in that the beads forming the netlike structure will rapidly wear out with the result that extra changing of rolls is necessary as well as making further indentations and depositing further beads. Making the indentations deeper in an effort to prolong the life of the rolls brings about an increase in dynamic loading upon the rolls and deterioration in the quality of the rolled metal due to rolling skins and other defects.

On the other hand, an increase in the rolling load leads to an improvement in the grip on the metal with a simultaneous increase in the amount of reduction of the metal being rolled, which eventually adds to the risk of slipping.

With an object to minimize the roll wear-out and particularly to level off the wear-out of the working surface along the roll length, it was proposed to subject a portion of the roll working surface to a strengthening treatment. Such a roll is disclosed in the Specification of the USSR Inventor's Certificate No. 151,976 and comprises a barrel the surface of which is covered with a working layer having portions of a different wear resistance. In the instant roll it was proposed to make the surface of the roll barrel more wear resistant at the middle portion thereof than at the end portions.

The prior art roll does not provide for a better adherence to the metal as compared to other prior art rolls, since the portions of unlike wear resistances are effective only along the roll length, while the provision of the indentations and corrugations on the working surface of this roll will present difficulties which are inherent in the roll described in the book by M. Ya. Brovman et al.

SUMMARY OF THE INVENTION

An object of the present invention is to provide a mill roll which improves the grip conditions for the metal being rolled for the life of the roll without an extra treatment thereof.

A further object of the invention is to provide a mill roll subjected to a lower dynamic load due to slippage.

A still further object of the invention is to provide a mill roll having the working layer which is less subjected to wear-out.

One more object of the present invention is to provide a mill roll providing for a higher throughput of the rolling mills.

These and other objects of the invention are accomplished by providing the roll working layer with portions of at least two materials of a different wear resistance each. The portions of a material of one wear resistance alternate with the portions of a material of a different wear resistance along both the circumference and the generating line of the roll barrel. Each portion, if viewed on a developed surface of the barrel, is a figure symmetrical about both the circumference of the barrel and the generating line thereof and is extending along the circumference of the barrel for 0.001 to 0.1 of contact arc length. Each of hereinabove mentioned portions has an axis of symmetry extending in a plane of the roll cross-section and inclined at an angle of $\pm 5°$ to $\pm 75°$ to the radius of the roll.

BRIEF DESCRIPTION OF THE DRAWING

The above-mentioned and other objects of the present invention as well as attending results thereof will become understood from the following detailed description thereof and the accompanying drawings, wherein.

DESCRIPTION OF THE PREFERRED EMBODIMENT

Figure 1:
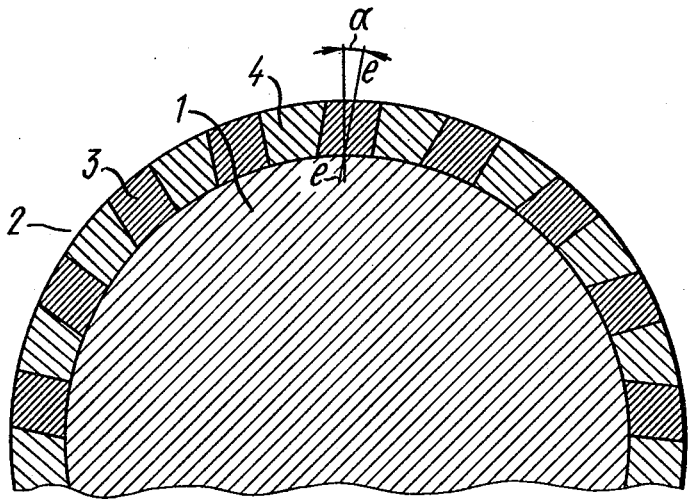
FIG. 1 is a cross-sectional view of the roll barrel wherein the portions of the working layer, which are made of a more wear-resistant material are shown by a more dense cross hatching.

Referring to FIG. 1, a mill roll comprises a barrel 1 whose surface is covered by a working layer 2. According to the invention the working layer 2 consists of two materials possessing different wear resistance, that is one of the materials is more wear-resistant than the other. A material more or less wear-resistant means herein a metal or metallic alloy possessing a predetermined wear resistance under rolling conditions of both ferrous and nonferrous metals. A material of higher resistance to wear forms less wearing portions 3 and likewise a material of lower resistance to wear forms more wearing portions 4. These portions may be termed also as a hardened portion 3 and non-hardened portion 4.

Figure 2:
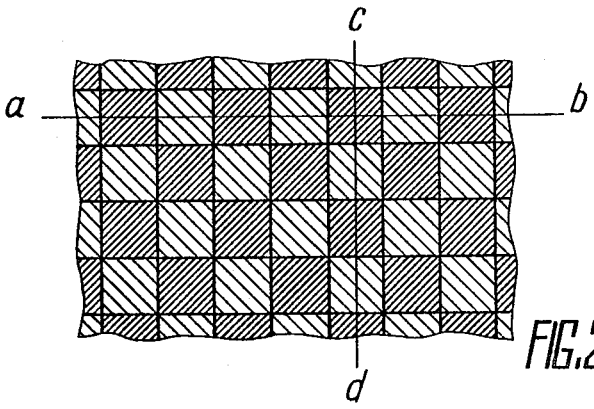
FIG. 2 is a fragmentary view of the working layer wherein the portions of a more wear-resistant material are for convenience cross hatched similar to like portions in FIG. 1.

Referring now to FIGS. 1 and 2, the portions of different wear resistance materials each alternate along both the circumference and the generating line of the barrel 1, that is the hardened portions 3 alternate with the non-hardened portions 4 in a way to form a pattern wherein the hardened portions, being represented in the drawings by a denser cross hatching, are suggestive of a checkerboard (FIG. 2).

FIG. 2 further shows that each hardened portion 3 as viewed on a developed surface of the barrel 1 is a figure symmetrical about both the circumference of the barrel 1, represented in the drawings by a line ab and the generating line cd thereof.

In the instant embodiment the hardened portions 3 are squares, though other forms are equally possible.

Reasoning from the function of these portions which will become apparent as the description proceeds, other forms thereof may be suggested, such as a rectangle, rhomb, circle, ellipse and some other as long as they satisfy the requirement of symmetry about both the circumference and the generating line of the barrel 1. It is to be understood that the checkerboard arrangement of the hardened portions 3 is beneficial for the same conditions as regards the above requirement in the non-hardened portions 4 too. The length of the hardened portions 3 (or the non-hardened portions 4) about the axes of symmetry is preferred in the range of 0.001 to 0.1 length of the arc of contact. This range can be explained by reasoning as follows. The minimum length (0.001) of the arc of contact is dictated by the necessity to produce a rough surface on the rolled product, for example on plates and sheets. The maximum length (full length) of the arc of contact is controlled by the grip on the metal rolled, for example in the blooming mills (break-down stands) and by the vapor blast effect to descale the rolled product. It is to be also noted that the hardened portions 3 may extend along the generating line of the barrel 1 as required, which may also apply to the wear resistance properties and to the materials possessing such properties, depending on the roll wear. According to varying wear resistance requirements, there may be used more than two materials, for example, in rolls for a Pilger mill or in rolls for producing rolled pieces of a varying cross-section.

Figure 4:
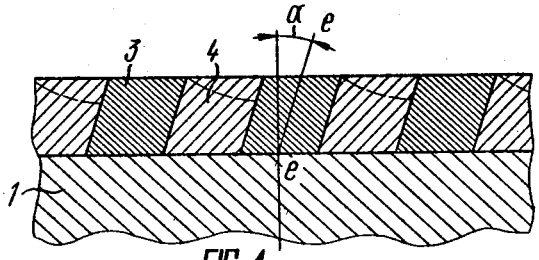
FIG. 4 is a view similar to that of FIG. 3 but showing portions of a more wear-resistant material, having their axes of symmetry extending at an angle to the radius of the roll.

As is best seen in FIGS. 1 and 4, the axis of symmetry, designated e—e, in each of the portions 3 and 4 is inclined with respect to the radius of the instant roll at an angle $\alpha$, which angle may be varied within $+5°$ to $+75°$ as a function of the roll (working layer) material and the metal to be rolled.

To illustrate the operation of the hardened portions, a working layer having hardened portions symmetrical about the radial axes is now considered.

Figure 3:
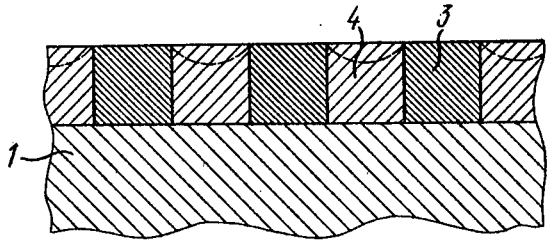
FIG. 3 is a cross-sectional view of a developed portion of the roll barrel having a working layer with portions of a more wear-resistant material, which portions having their axes of symmetry extending radially.

To assure a selective wearing of the working layer during the whole life of the roll, the working layer of a metal of differing wear resistance may be applied to the barrel of the roll as shown in FIG. 3 with due consideration for invariable properties of the material in the hardened portions through the thickness of the working layer.

In operation, the contour interval on the working face of the roller becomes greater than that which may be tolerated as the nonhardened portions 4 wear out (shown in dotted lines), which eventually leads to the formation of laps.

In order to preserve a predetermined depth of the indentations, the invention then consists in that the axes of symmetry of the hardened portions 3 are inclined at an angle $\alpha$ (FIGS. 1 and 4) with respect to the radius of the roll, which eliminates the above disadvantage. As the non-hardened portions 4 wear out (shown in dotted lines), the hardened portions 3 are gradually exposed. The more these portions (indentations) wear out, the smaller becomes the contact between the non-hardened portions and the metal being rolled, so that the rolling load is taken by the hardened portions. This makes the indentation depth more stable. The depth of the indentations may be varied by varying the angle $\alpha$ and the difference in wear resistance of the hardened and non-hardened portions.

Figure 5:
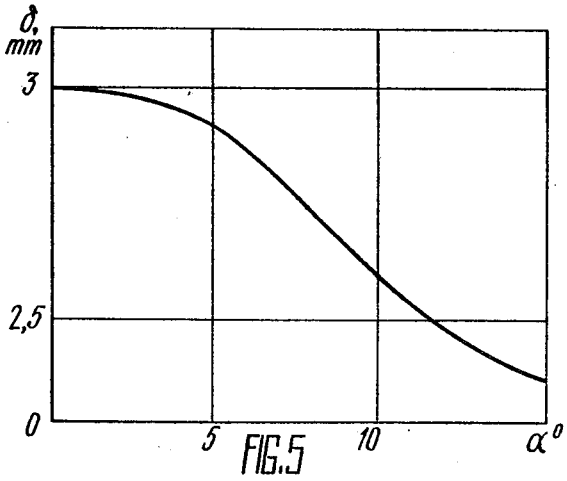
FIG. 5 is a diagram showing variations of the indentation depths with an angle of inclination of the axis of symmetry of the portion of a more wear-resistant material.

FIG. 5 is a diagram showing variations of the indentation depths with an angle of inclination of the axis of symmetry of the hardened portion to the radius of the roll, wherein the angles, degrees (°), of inclination of the axes of symmetry to the radius of the roll are plotted along the x-axis, while the indentation depths (mm) are plotted along the y-axis. The diagram has been plotted from experimental data and is to show that irrespective of the wear resistance-to-wear resistance ratio in hardened and non-hardened portions, the latter ceases to intensively wear out (indentation depth) at the angle of inclination of the hardened portion, equal 5° or more only. If the angle of inclination is greater than 75°, the hardened portions begin to overlap the nonhardened portions and naturally the indentations are not formed.

As to the configuration of the hardened portions as they are seen on the developed surface of the working layer, the deviation from symmetrical about the circumference and the generating line of the barrel 1 will develop axial forces which cause lateral flow of the metal being rolled and thus disturb the normal operation of the rolling process.

The invention herewith shown and described, is to be taken as a preferred embodiment, and that various changes in the shape, size and arrangement of parts may be resorted to, without departing from the spirit of the invention, or the scope of the claims below.

What is claimed is:

1. A mill roll comprising a barrel and a working layer deposited on said barrel and having alternate portions of at least two materials of a different wear resistance each correspondingly along both the circumference and the generating line of said barrel, each portion of said working layer, on a developed surface of said barrel, being a figure symmetrical about both the circumference of said barrel and the generating line thereof, and extending along the circumference of said barrel for 0.001 to 0.1 of contact arc length and, in a plane of the roll cross-section, the angle between the axis of symmetry of each portion of said working layer and the radius of the same roll is from $+5°$ to $+75°$.

* * * * *